US008109124B2

(12) United States Patent
Lin

(10) Patent No.: US 8,109,124 B2
(45) Date of Patent: Feb. 7, 2012

(54) SPLIT STRAP

(75) Inventor: Jin-Jie Lin, Livermore, CA (US)

(73) Assignee: Simpson Strong-Tie Company, Pleasanton, CA (US)

( * ) Notice: Subject to any disclaimer, the term of this patent is extended or adjusted under 35 U.S.C. 154(b) by 698 days.

(21) Appl. No.: 12/347,963

(22) Filed: Dec. 31, 2008

(65) Prior Publication Data

US 2010/0162783 A1 Jul. 1, 2010

(51) Int. Cl.

| | |
|---|---|
| ***B21C 3/02*** | (2006.01) |
| ***B65D 85/66*** | (2006.01) |
| ***B21D 28/00*** | (2006.01) |
| *B65H 16/00* | (2006.01) |

(52) U.S. Cl. ..... 72/176; 72/274; 72/324; 72/379.2; 242/588.6; 242/137.1; 52/741.1; 52/749.1

(58) Field of Classification Search ..... 72/176, 72/274, 275, 324, 335, 379.2; 242/137.1, 242/588.6; 52/741.1, 745.19, 749.1; 428/152
See application file for complete search history.

(56) References Cited

U.S. PATENT DOCUMENTS

| | | | | |
|---|---|---|---|---|
| 1,320,220 | A | | 10/1919 | Forbes |
| 1,479,431 | A | | 6/1922 | Gerrard et al. |
| 1,656,741 | A | | 1/1928 | Lane |
| 1,666,105 | A | | 4/1928 | Mosler |
| 1,685,729 | A | | 9/1928 | Stone |
| 1,816,385 | A | | 7/1931 | Matthaei |
| 2,302,101 | A | | 11/1942 | Boydstun |
| 2,389,573 | A | | 11/1945 | Balduf |
| 2,400,698 | A | | 5/1946 | Lissa |
| 2,506,354 | A | | 5/1950 | Green |
| 2,560,786 | A | * | 7/1951 | Wright et al. ..... 72/324 |
| 2,595,375 | A | | 5/1952 | Weirich et al. |
| 2,706,592 | A | | 4/1955 | Schaller |
| 2,713,938 | A | | 7/1955 | Snyder |
| 2,796,170 | A | | 6/1957 | Davis |
| 2,844,334 | A | | 7/1958 | Luth |
| 2,856,646 | A | | 10/1958 | Latimer et al. |
| 2,964,807 | A | | 12/1960 | Kennedy |
| 2,986,193 | A | | 5/1961 | Howell |
| 3,004,640 | A | | 10/1961 | Macomber |
| 3,010,162 | A | | 11/1961 | Klein |
| 3,115,243 | A | | 12/1963 | Nash |
| 3,149,719 | A | | 9/1964 | Thompson et al. |
| 3,279,590 | A | | 10/1966 | Gould et al. |
| 3,329,259 | A | | 7/1967 | Mayer |

(Continued)

FOREIGN PATENT DOCUMENTS

| | | |
|---|---|---|
| AU | 50272 | 6/1977 |

(Continued)

OTHER PUBLICATIONS

Handvaerkerkatalog 1989, 8 pages, Boulstrup, Denmark.

(Continued)

*Primary Examiner* — David Jones
(74) *Attorney, Agent, or Firm* — James R. Cypher; Charles R. Cypher

(57) ABSTRACT

An elongated strap member that is coiled in a box and is bent lengthwise as it is drawn out of the box, providing an economical, light, compact means of connecting multiple structural members without sagging or other disadvantageous deformations between the structural members. The structural members are bridged by strap member. The end of the strap member is bent over.

15 Claims, 9 Drawing Sheets

U.S. PATENT DOCUMENTS

| | | | | |
|---|---|---|---|---|
| 3,332,196 | A | 7/1967 | Tuttle | |
| 3,335,993 | A | 8/1967 | Tuttle | |
| 3,446,419 | A | 5/1969 | Mueller | |
| 3,591,997 | A | 7/1971 | Tennison, Jr. | |
| 3,602,024 | A | 8/1971 | Sabroff | |
| 3,602,452 | A | 8/1971 | Sauer | |
| 3,680,810 | A | 8/1972 | Jarmalow | |
| 3,810,588 | A | 5/1974 | Mahoney | |
| 3,875,719 | A | 4/1975 | Menge | |
| 3,959,945 | A | 6/1976 | Allen | |
| 3,982,712 | A | 9/1976 | Bassett | |
| 4,016,698 | A | 4/1977 | Rogers | |
| 4,040,232 | A | 8/1977 | Snow et al. | |
| 4,130,970 | A | 12/1978 | Cable | |
| 4,157,002 | A | 6/1979 | Adolph | |
| 4,239,110 | A | 12/1980 | Enke et al. | |
| 4,339,903 | A | 7/1982 | Menge | |
| 4,345,409 | A | 8/1982 | Schroeder et al. | |
| 4,367,973 | A | 1/1983 | Gilb et al. | |
| 4,370,843 | A | 2/1983 | Menge | |
| 4,396,165 | A | 8/1983 | Bates et al. | |
| 4,503,652 | A | 3/1985 | Turner | |
| 4,524,554 | A | 6/1985 | Simpson | |
| 4,563,851 | A | 1/1986 | Long | |
| 4,604,845 | A | 8/1986 | Brinker | |
| 4,616,469 | A | 10/1986 | Skalleberg | |
| 4,637,195 | A | 1/1987 | Davis | |
| 4,817,798 | A | 4/1989 | Huang | |
| 4,843,726 | A | 7/1989 | Ward | |
| 5,161,345 | A | 11/1992 | Sobjack, Sr. | |
| 5,284,247 | A | 2/1994 | Turner | |
| 5,315,803 | A | 5/1994 | Turner | |
| 5,388,378 | A | 2/1995 | Frye | |
| 5,454,203 | A | 10/1995 | Turner | |
| 5,606,837 | A | 3/1997 | Holizlander | |
| 5,937,608 | A | 8/1999 | Kucirka | |
| 6,176,064 | B1 * | 1/2001 | Janelle | 72/253.1 |
| 6,185,898 | B1 | 2/2001 | Pratt | |
| 6,418,695 | B1 | 7/2002 | Daudet et al. | |
| 6,640,605 | B2 * | 11/2003 | Gitlin et al. | 72/379.2 |
| 6,877,291 | B2 | 4/2005 | Shamroukh et al. | |
| 6,988,346 | B2 | 1/2006 | Shamroukh et al. | |
| 6,993,882 | B2 | 2/2006 | Crawford et al. | |
| 7,111,485 | B1 | 9/2006 | Fiore | |
| 7,213,377 | B1 | 5/2007 | Sackett | |
| 7,249,729 | B2 * | 7/2007 | Moritz | 242/588.6 |
| 7,263,869 | B2 * | 9/2007 | Durney et al. | 72/324 |
| D575,139 | S | 8/2008 | LePoire et al. | |
| 7,464,574 | B2 * | 12/2008 | Durney et al. | 72/324 |
| 8,047,038 | B2 * | 11/2011 | Owens, IV | 72/176 |
| 2006/0163417 | A1 * | 7/2006 | Moritz | 242/588.6 |

FOREIGN PATENT DOCUMENTS

| | | | |
|---|---|---|---|
| AU | 2006100777 | A6 | 11/2006 |
| GB | 2301604 | B | 9/1999 |

OTHER PUBLICATIONS

WBF Wind Bracing, TSX Truss Spacer, 2 pages, United Steel Products, Montgomery. MN, published at least as early as 2001, USA.

Guertin, Mike & Arnold, Rick, Installing Gable Roof Trusses, Journal of Light Construction, Dec. 1998, pp. 37-42, p. 8 and cover, Builderburg Partners, Ltd., Washington DC, USA.

Truss Products, Catalog p. 10, 1995, Tee-Lok Corporation, USA.

Commentary and Recommendations for Handling and Installing Bracing, HIB-91, Truss Plate Institute, published at least as early as 2001, USA.

Connectors for Wood Construction Product & Instruction Manual, Catalog c-94H-1, p. 64 and cover page, 1993, Simpson Strong-Tie Company, Inc., USA.

Wood Construction Conncectors, Catalog C-2000, pp. 100,101, 117, 118 and cover page, Jan. 1, 2000, Simpson Strong-Tie Tie Company, Inc., U.S.A/.

* cited by examiner

SPLIT STRAP

BACKGROUND OF THE INVENTION

The present invention relates to a connection in which an elongated strap is provided flat and coiled and is bent by the action of drawing it out of its box. Such straps and connectors are used in a variety of building applications, typically in connections that resist tension forces parallel to the main axes of the straps or strap members. A number of connectors with elongated strap members are in common use with a variety of structural members.

The present invention relates to a connection in which a strap bridges a plurality of substantially parallel structural members and can be secured by a strap holder, especially where an elongate utility strap is used, typically in pairs forming X bracing, to reinforce roof trusses against forces acting along the length of the roof. Single diagonal braces of this general type are also commonly used in walls in light wood frame construction, and might also be used to brace floor beams or other series of parallel structural members.

SUMMARY OF THE INVENTION

It is an object of the present invention to provide a secure connection between an elongated strap member and a structural member. The present invention improves on the prior art of providing either a flat, coiled strap that remains flat when uncoiled, or shorter connectors that are formed to remain straight. The present invention provides an elongated strap member that is coiled in a box and is bent lengthwise as it is drawn out of the box, providing an economical, light, compact means of connecting multiple structural members without sagging or other disadvantageous deformations between the structural members. The structural members are bridged by the strap member. The end of the strap member is bent over.

Fasteners hold the strap to the underlying structural members, with at least one, and preferably two, passing through the strap into each structural member.

DETAILED DESCRIPTION OF THE INVENTION

Figure 1:
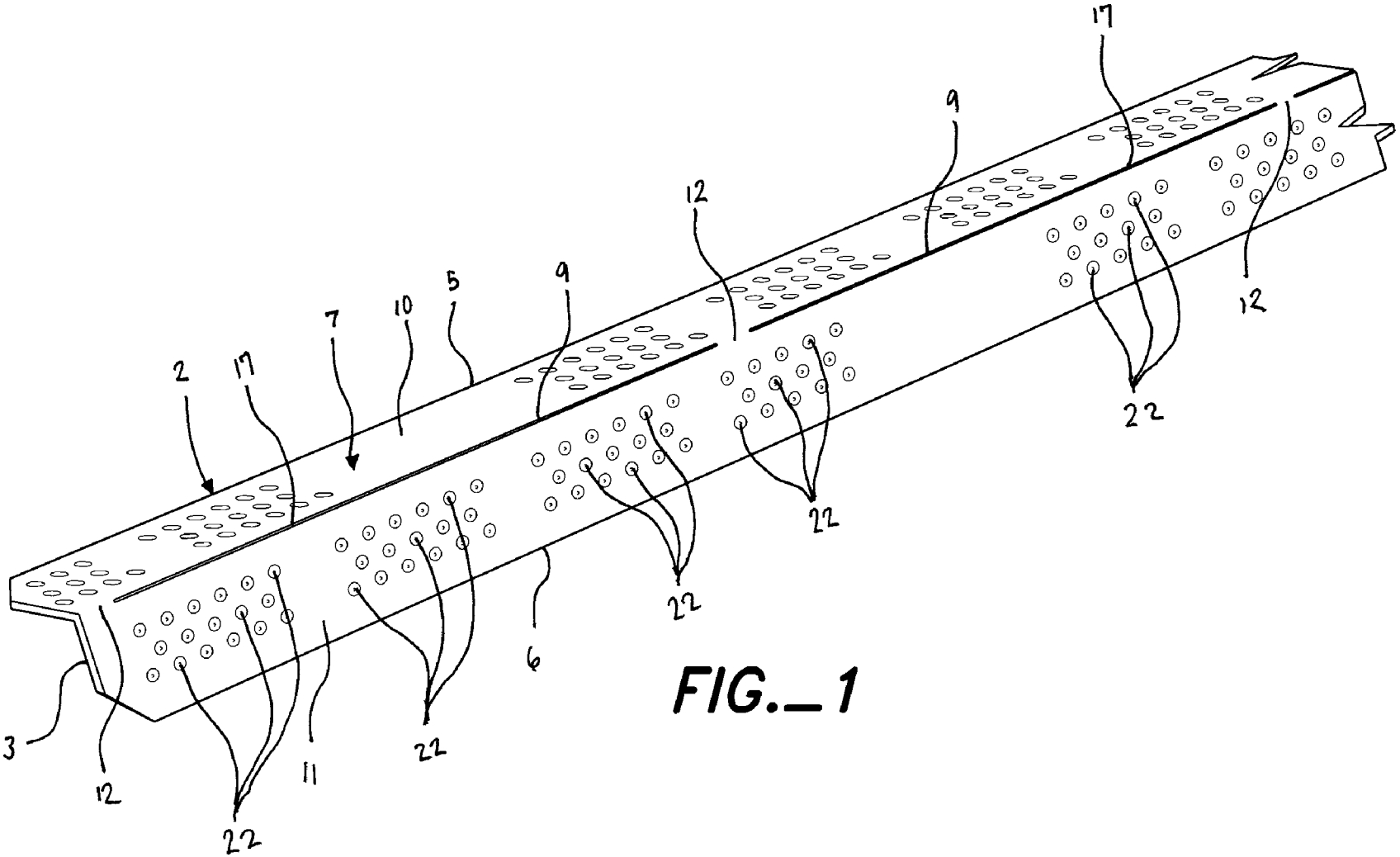
FIG. 1 is a perspective view of the bent split strap of the present invention.
Figure 2:
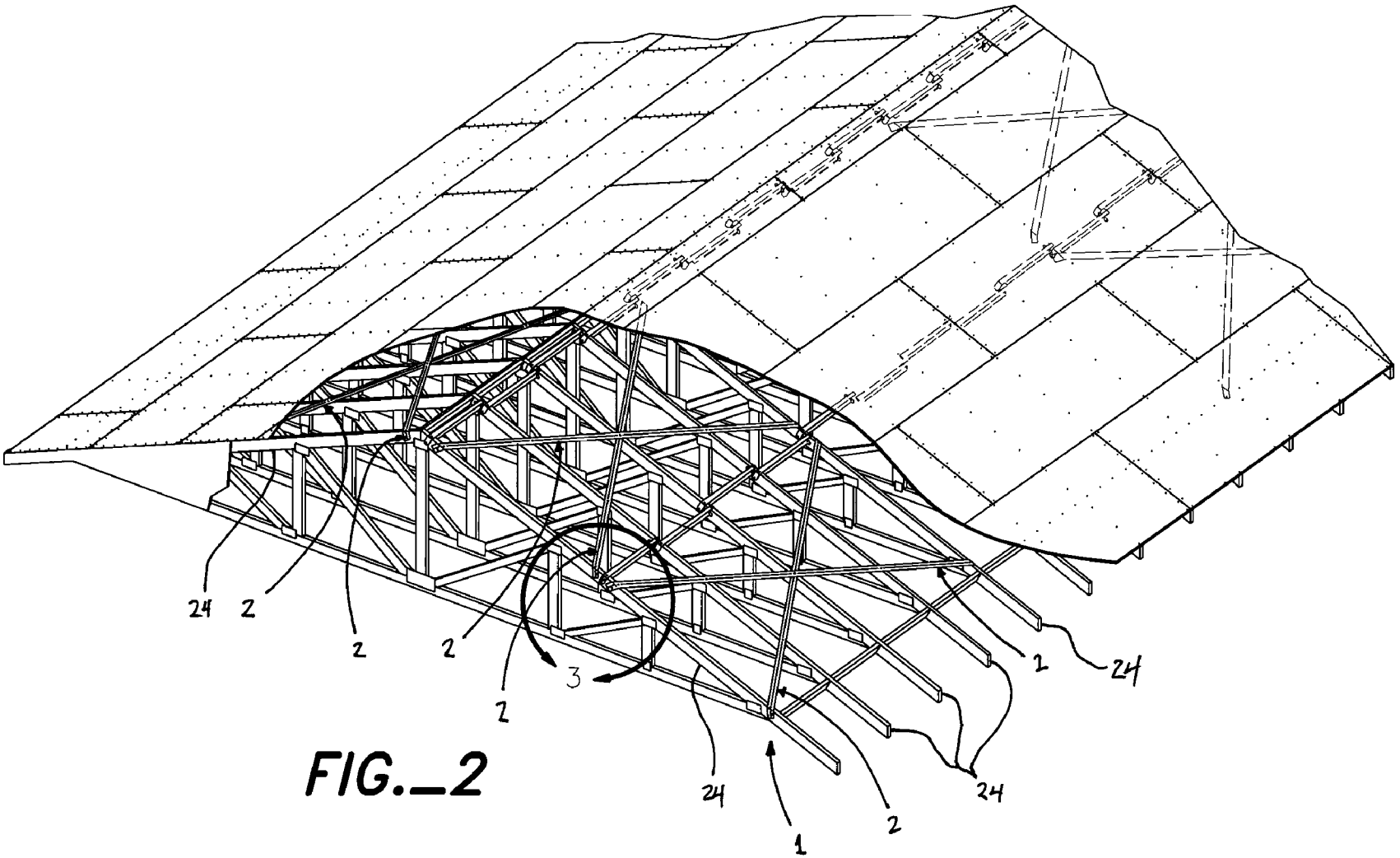
FIG. 2 is a perspective view of the bent split strap connection of the present invention, in which the connected structural members are roof truss top chords.
Figure 3:
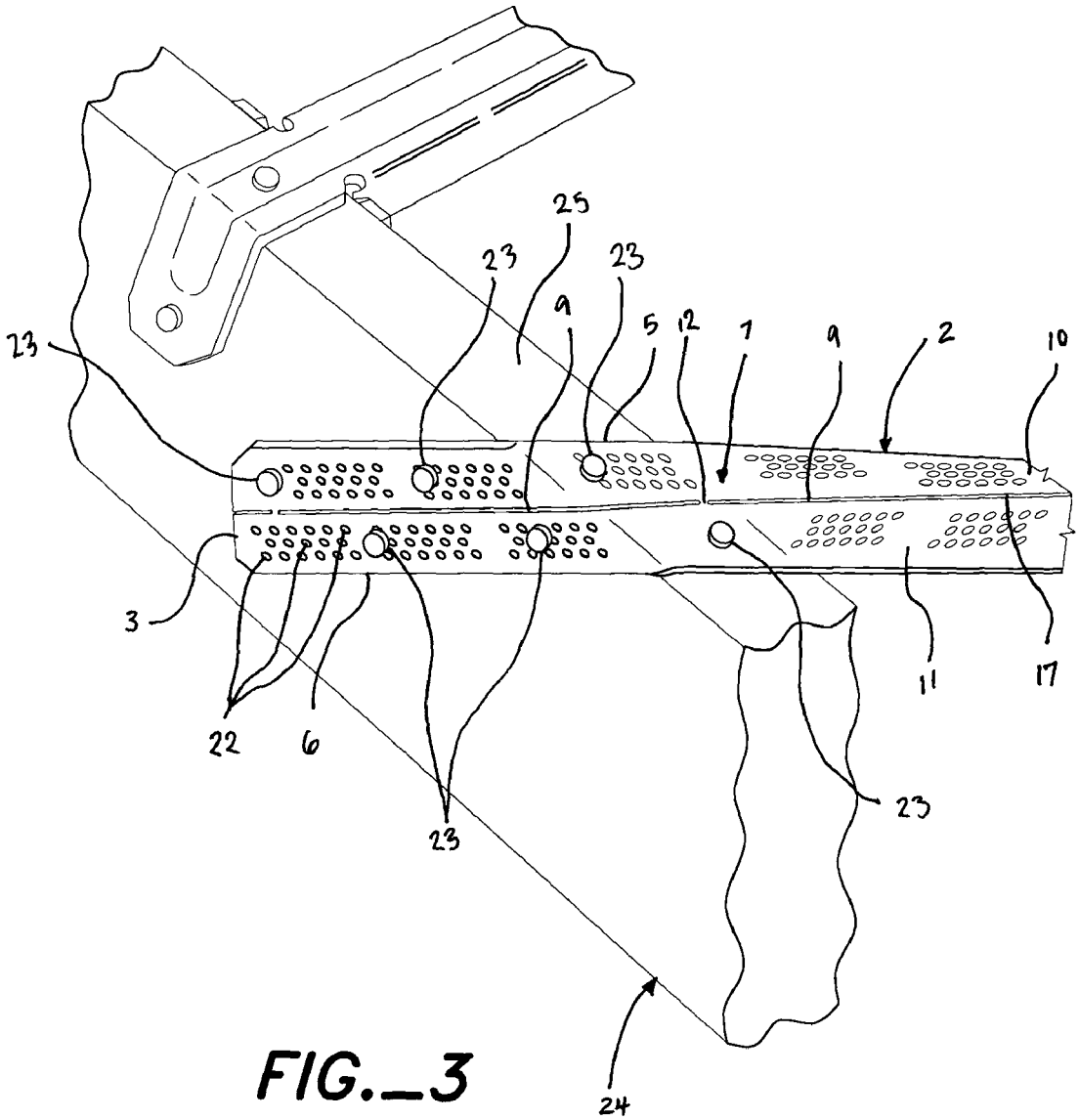
FIG. 3 is a perspective view of a flattened end of the bent split strap of the present invention nailed off on the vertical side face of a roof truss top chord.
Figure 4:
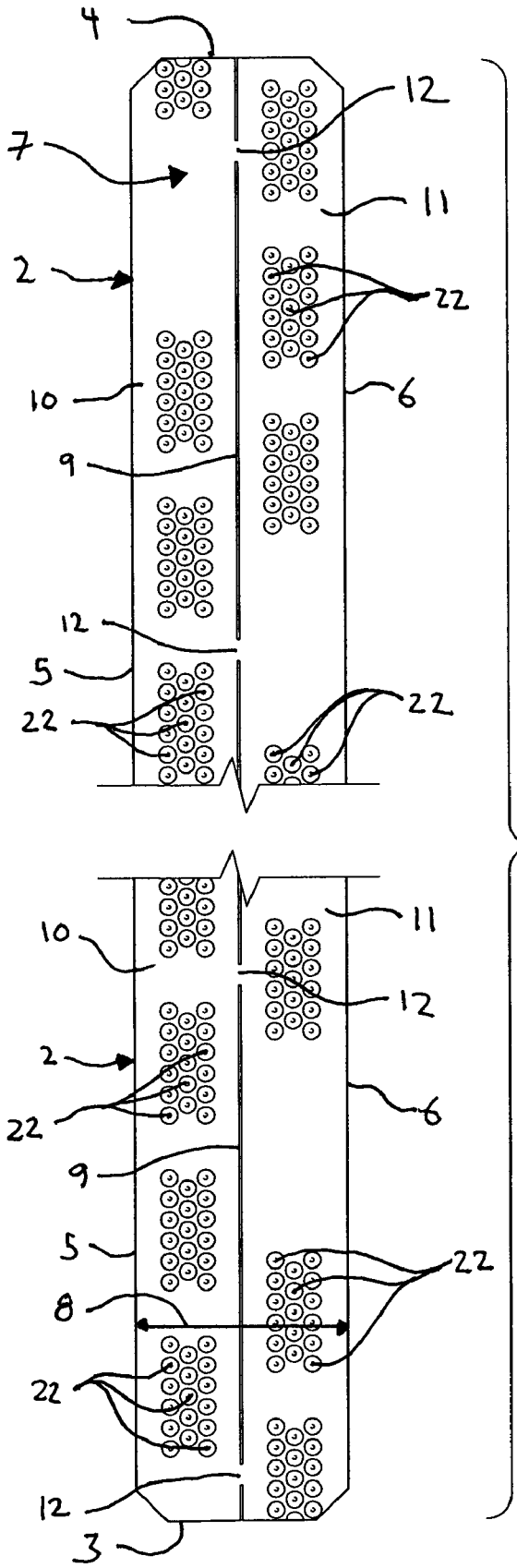
FIG. 4 is a top plan view of the elongated strap of the present invention before it is bent.
Figure 5:
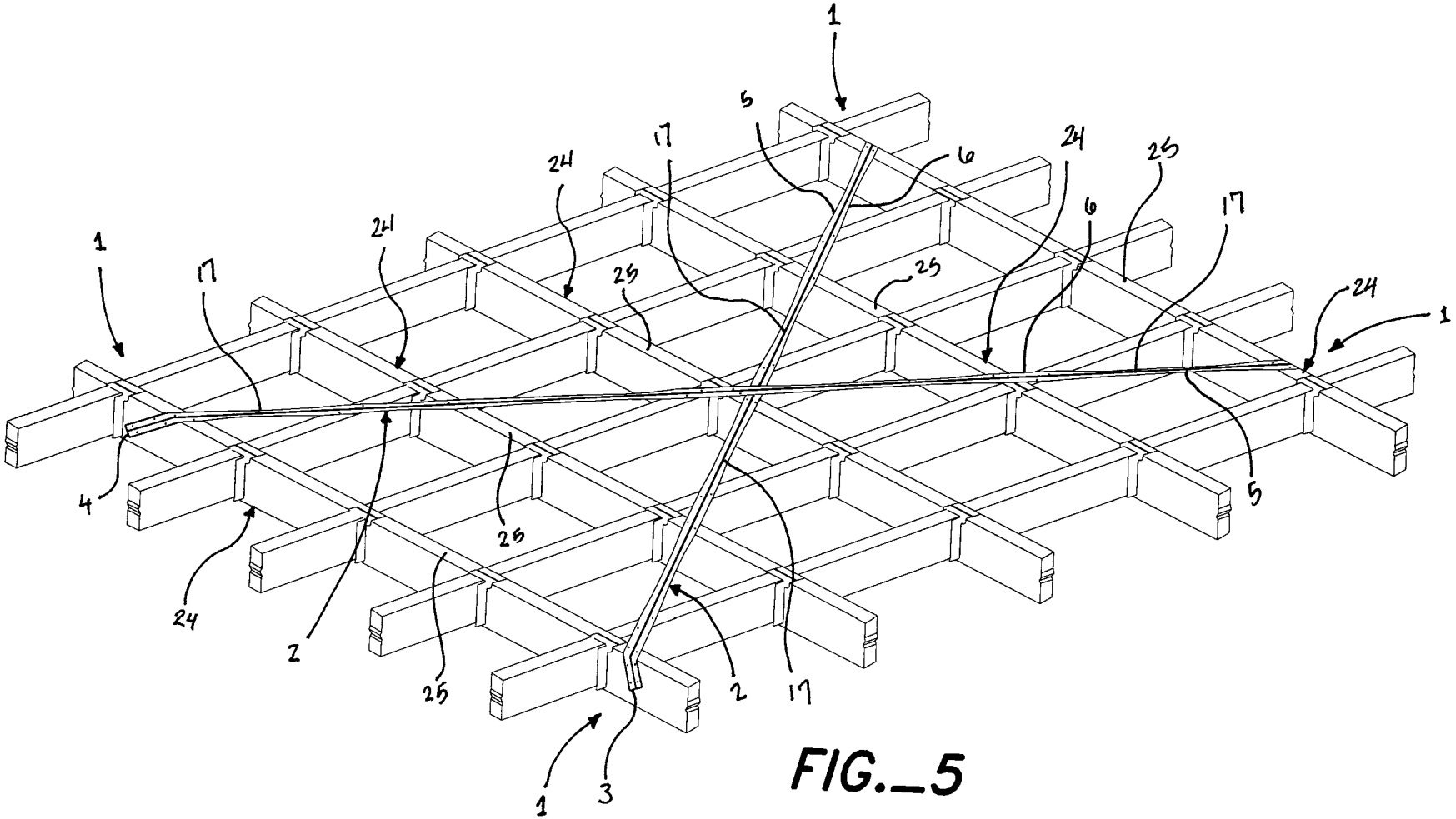
FIG. 5 is a perspective view of the bent split strap connection of the present invention in which the connected structural members are floor joists.
Figure 6:
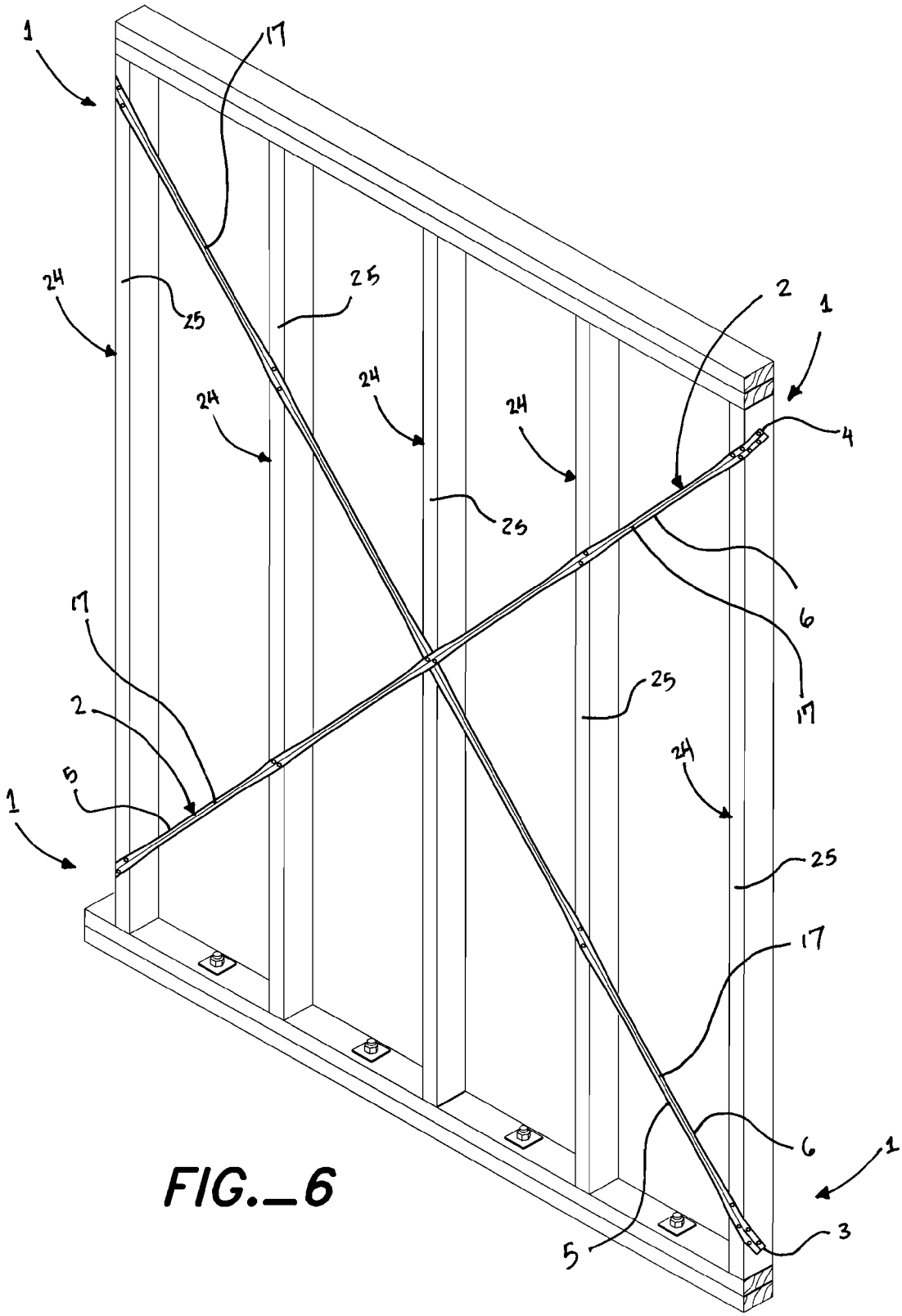
FIG. 6 is a perspective view of the bent split strap connection of the present invention in which the connected structural members are wall studs.
Figure 7:
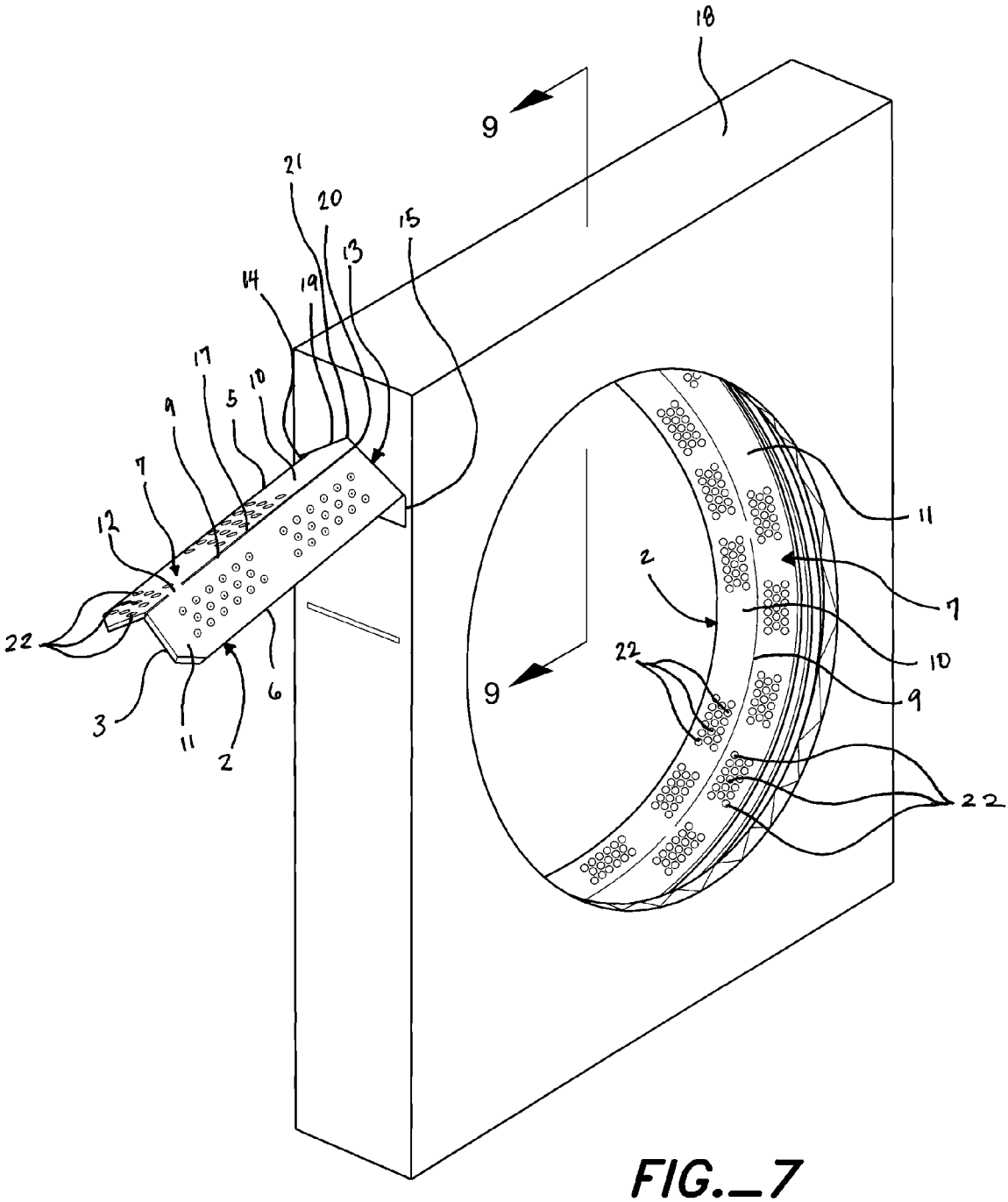
FIG. 7 is a perspective view of the strap of the present invention, showing it coiled flat in a box and bent as it is drawn through the aperture of the present invention.
Figure 8:
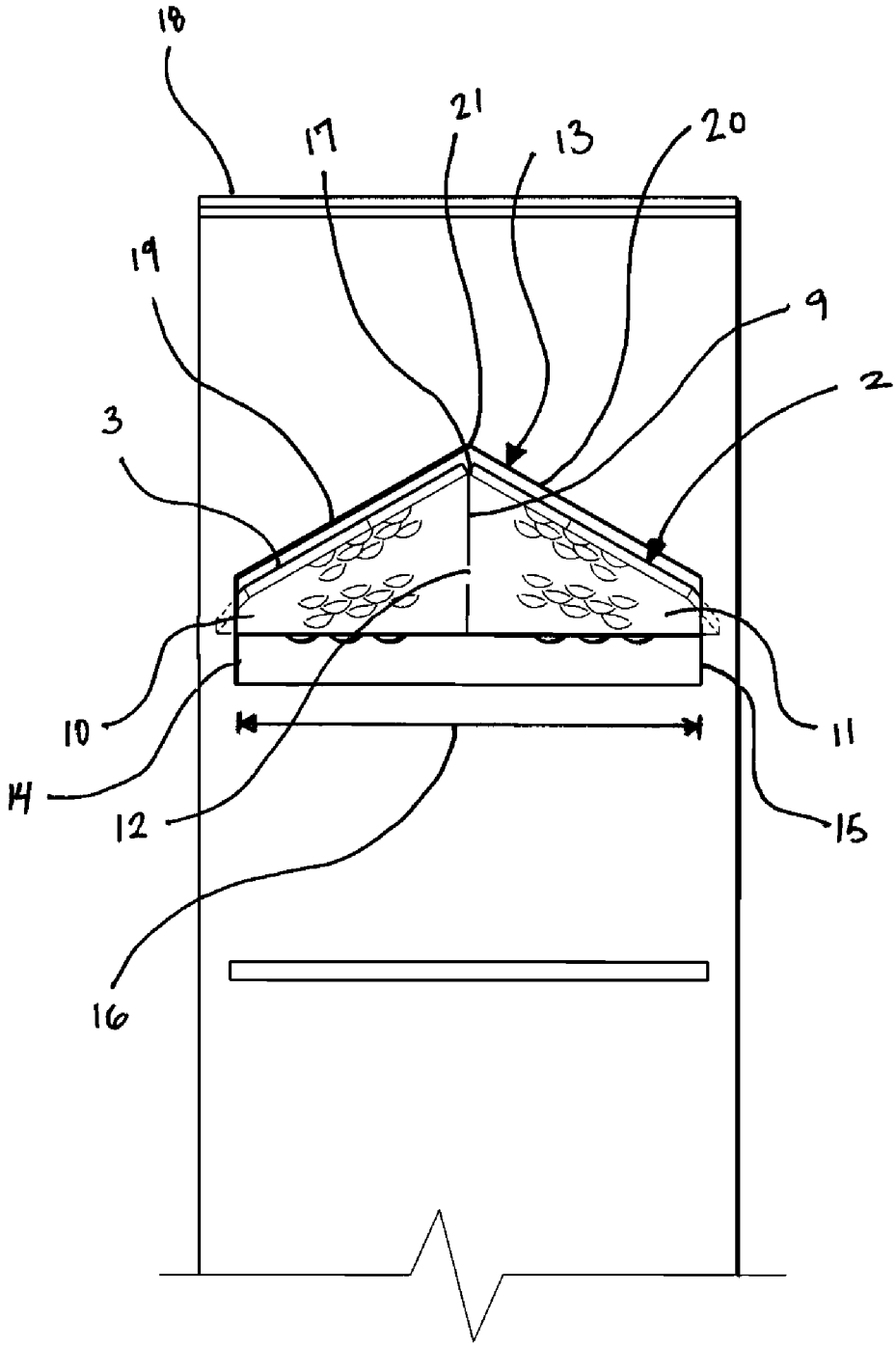
FIG. 8 is an elevation view taken along line 8-8 in FIG. 7, showing the formation of the bent split strap as it is drawn through the aperture of the present invention.
Figure 9:
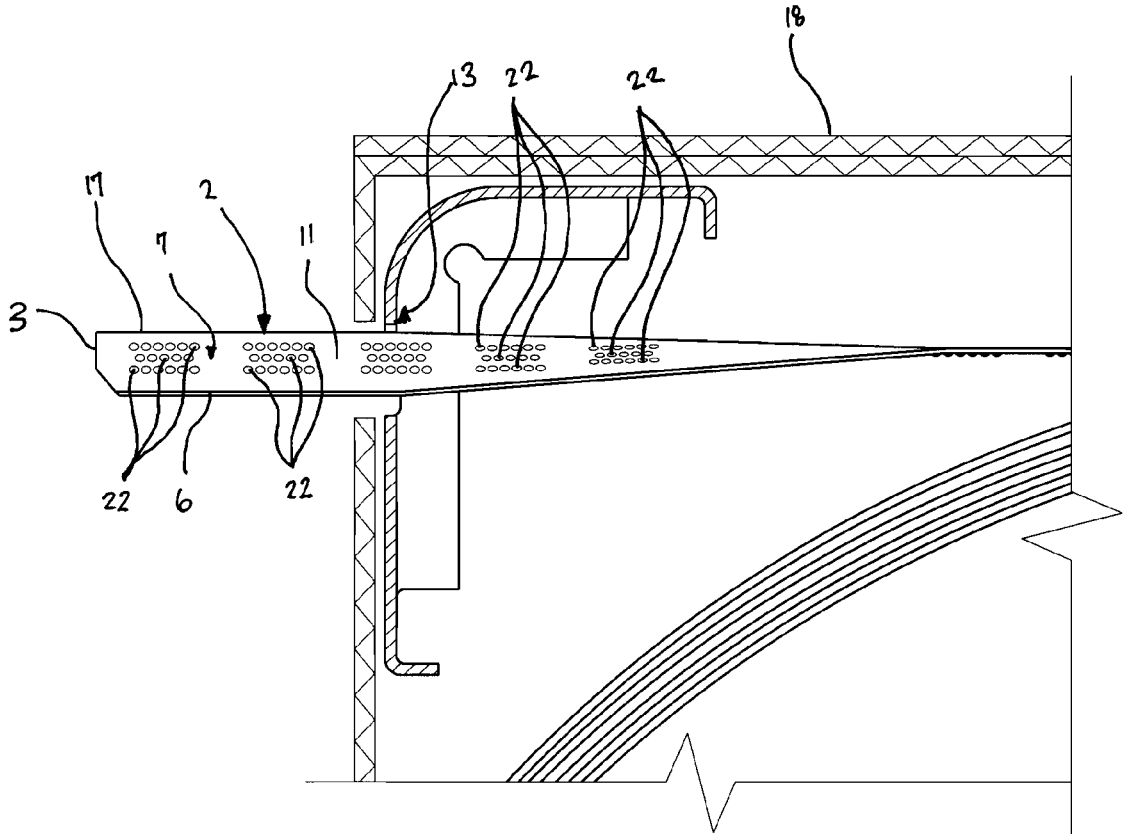
FIG. 9 is a side elevation view of the strap of the present invention, showing it coiled flat in a box and bent as it is drawn through the preferred embodiment of the aperture of the present invention.
Figure 10:
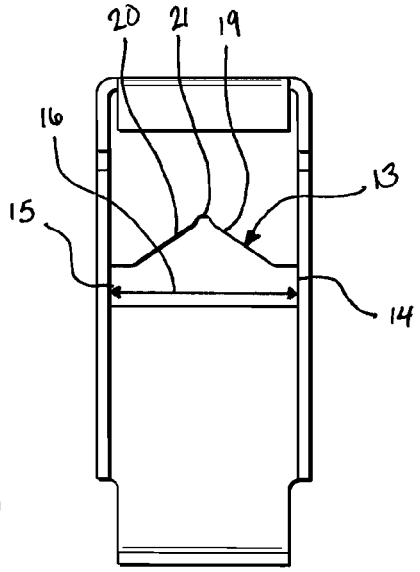
FIG. 10 is a back elevation view of the preferred embodiment of the aperture of the present invention.

The present invention is a method of making a bent split strap 2 that comprises providing a generally flat, coiled, elongated strap 2 in a box 18, providing an aperture 13, and drawing the elongated strap 2 through the aperture 13 to bend it lengthwise.

Preferably, the generally flat, coiled, elongated strap 2 has a leading end 3 and a trailing end 4, a first elongated side boundary 5 and a second elongated side boundary 6 generally parallel to the first elongated side boundary 5, a body 7 bounded by the first and second elongated side boundaries 5, 6 that define a width 8, and an elongated slit cut 9 generally parallel to the first and second elongated side boundaries 5, 6. The slit cut 9 divides the body 7 between the first and second elongated side boundaries 5, 6, creating a first body side 10 and a second body side 11. The slit cut 9 is intermittently interrupted by unslit portions 12 that connect the first and second body sides 10, 11.

The aperture 13 preferably has a first end 14 and a second end 15 that define a width 16. The width 16 of the aperture 13 is less than the width 8 of the elongated strap 2.

Preferably, the elongated strap 2 is drawn through the aperture 13 so that the first and second ends 14, 15 of the aperture 13 constrict the elongated strap 2 by bearing on the first and second elongated side boundaries 5, 6, thereby bending the elongated strap 2 along the slit cut 9 to create an elongated bend 17 in the elongated strap 2.

The elongated strap 2 is preferably provided in a box 18 that contains the majority of the elongated strap 2.

Preferably, the aperture 13 has a first straight leg 19 and a second straight leg 20. The first and second straight legs 19, 20 meet at a first angular juncture 21. The elongated strap 2 is drawn through the aperture 13 so that the slit cut 9 coincides with the first angular juncture 21. The first body side 10 coincides with the first straight leg 19, and the second body side 11 coincides with the second straight leg 20, thereby bending the elongated strap 2 along the slit cut 9 to create the elongated bend 17 in the elongated strap 19.

The first body side 10 and the second body side 11 preferably are stamped with repeating patterns of dimples 22 that aid in positioning fasteners 23 by providing areas of higher friction than the undimpled portions of the first body side 10. The repeating pattern of dimples 22 also strengthens the first and second body sides 10 and 11 to help minimize sagging of the elongated strap 2 when it is installed.

The present invention is also a method of making a bent split strap connection 1. The method comprises providing a generally flat, coiled, elongated strap 2, providing an aperture 13, drawing the elongated strap 2 through the aperture 13, cutting a length of the bent split strap 2, providing a plurality of parallel structural members 24, and fastening the bent split strap 2 to the structural members 24.

Preferably, the generally flat, coiled, elongated strap 2 has a leading end 3 and a trailing end 4, a first elongated side boundary 5 and a second elongated side boundary 6 generally parallel to the first elongated side boundary 5, a body 7 bounded by the first and second elongated side boundaries 5, 6 that define a width 8, and an elongated slit cut 9 generally parallel to the first and second elongated side boundaries 5, 6.

The slit cut 9 divides the body 7 between the first and second elongated side boundaries 5, 6, creating a first body side 10 and a second body side 11. The slit cut 9 is intermittently interrupted by unslit portions 12 that connect the first and second body sides 10, 11.

The aperture 13 preferably has a first end 14 and a second end 15 that define a width 16. The width 16 of the aperture 13 is less than the width 8 of the elongated strap 2.

Preferably, the elongated strap 2 is drawn through the aperture 13 so that the first and second ends 14, 15 of the aperture 13 constrict the elongated strap 2 by bearing on the first and second elongated side boundaries 5, 6, thereby bending the elongated strap 2 along the slit cut 9 to create an elongated bend 17 in the elongated strap 2.

A length of the bent split strap 2 preferably is cut. Preferably, a plurality of parallel structural members 24 is provided, the structural members 24 each having an interface surface 25. The body 7 of the length of the bent split strap 2 preferably is fastened onto each of the interface surfaces 25 of the structural members 24.

Preferably, the bent split strap 2 is fastened onto the interface surface 25 of the structural members 25 with a plurality of fasteners 23. Preferably, at least one of the fasteners 23 penetrates each of the structural members 24.

In a preferred embodiment, the structural members 24 are made of wood. In that embodiment, the fasteners 23 preferably are nails 23. In another embodiment, the structural members 24 are made of metal. In that embodiment, the fasteners 23 preferably are screws 23.

In a preferred embodiment, the structural members 24 are wall studs 24. In another preferred embodiment, the structural members 24 are floor beams 24. In the most preferred embodiment, the structural members 24 are truss chords 24. Specifically, the truss chords 24 preferably are the top chords 24 of roof trusses.

Preferably, the bent split strap 2 is flattened where it is fastened to the structural members 24 and remains bent between the structural members 24 so that it does not sag.

Preferably, the box 18 contains a 200 foot length of elongated strap 2. Preferably, the width 8 of the strap in 1¼ inches. Preferably, the elongated strap 2 is made from 22 gauge G90 galvanized steel.

I claim:

1. A method of making a bent split strap (2), comprising:

(a) providing a generally flat, coiled, elongated strap (2) having a leading end (3) and a trailing end (4), a first elongated side boundary (5) and a second elongated side boundary (6) generally parallel to said first elongated side boundary (5), a body (7) bounded by said first and second elongated side boundaries (5, 6) that define a width (8), and an elongated slit cut (9) generally parallel to said first and second elongated side boundaries (5, 6), said slit cut (9) dividing said body (7) between said first and second elongated side boundaries (5, 6), creating a first body side (10) and a second body side (11), said slit cut (9) being intermittently interrupted by unslit portions (12) that connect said first and second body sides (10, 11);

(b) providing an aperture (13) having a first end (14) and a second end (15) that define a width (16), said width (16) of said aperture (13) being less than said width (8) of said elongated strap (2); and (c) drawing said elongated strap (2) through said aperture (13) so that said first and second ends (14, 15) of said aperture (13) constrict said elongated strap (2) by bearing on said first and second elongated side boundaries (5, 6), thereby bending said elongated strap (2) along said slit cut (9) to create an elongated bend (17) in said elongated strap (2);

wherein:

i. said elongated strap (2) is provided in a box (18) that contains the majority of said elongated strap (2).

2. The method of claim 1, wherein:

(a) said aperture (13) is has a first straight leg (19) and a second straight leg (20), said first and second straight legs (19, 20) meeting at a first angular juncture (21); and (b) said elongated strap (2) is drawn through said aperture (13) so that said slit cut (9) coincides with said first angular juncture (21), said first body side (10) coincides with said first straight leg (19), and said second body side (11) coincides with said second straight leg (20), thereby bending said elongated strap (2) along said slit cut (9) to create said elongated bend (17) in said elongated strap (19).

3. The method of claim 1, wherein:

(a) said first body side (10) and said second body side (11) are stamped with repeating patterns of dimples (22) that aid in positioning fasteners (23) by providing areas of higher friction than the undimpled portions of said first body side (10).

4. A method of making a bent split strap connection (1), comprising:

(a) providing a generally flat, coiled, elongated strap (2) having a leading end (3) and a trailing end (4), a first elongated side boundary (5) and a second elongated side boundary (6) generally parallel to said first elongated side boundary (5), a body (7) bounded by said first and second elongated side boundaries (5, 6) that define a width (8), and an elongated slit cut (9) generally parallel to said first and second elongated side boundaries (5, 6), said slit cut (9) dividing said body (7) between said first and second elongated side boundaries (5, 6), creating a first body side (10) and a second body side (11), said slit cut (9) being intermittently interrupted by unslit portions (12) that connect said first and second body sides (10, 11);

(b) providing an aperture (13) having a first end (14) and a second end (15) that define a width (16), said width (16) of said aperture (13) being less than said width (8) of said elongated strap (2);

(c) drawing said elongated strap (2) through said aperture (13) so that said first and second ends (14, 15) of said aperture (13) constrict said elongated strap (2) by bearing on said first and second elongated side boundaries (5, 6), thereby bending said elongated strap (2) along said slit cut (9) to create an elongated bend (17) in said elongated strap (2);

(d) cutting a length of said bent split strap (2);

(e) providing a plurality of parallel structural members (24), said structural members (24) each having an interface surface (25);

(f) fastening said body (7) of said length of said bent split strap (2) onto each of said interface surfaces (25) of said structural members (24).

5. The method of claim 4, wherein:

(a) said bent split strap (2) is fastened onto said interface surface (25) of said structural members (25) with a plurality of fasteners (23).

6. The method of claim 5, wherein:

(a) at least one of said fasteners (23) penetrates each of said structural members (24).

7. The method of claim 6, wherein:

(a) said structural members (24) are made of wood.

8. The method of claim 7, wherein:

(a) said fasteners (23) are nails (23).

9. The method of claim 6, wherein:

(a) said structural members (24) are made of metal.

10. The method of claim 9, wherein:

(a) said fasteners (23) are screws (23).

11. The method of claim 4, wherein:

(a) said structural members (24) are wall studs (24).

12. The method of claim 4, wherein:

(a) said structural members (24) are floor beams (24).

13. The method of claim 4, wherein:

(a) said structural members (24) are truss chords (24).

14. The method of claim 13, wherein:

(a) said truss chords (24) are the top chords (24) of roof trusses.

15. The method of claim 4, wherein:

(a) said bent split strap (2) is flattened where it is fastened to said structural members (24) and remains bent between said structural members (24) so that it does not sag.

* * * * *